United States Patent [19]

Larin

[11] 4,009,585

[45] Mar. 1, 1977

[54] METHOD OF PRODUCING VACUUM IN RECIPIENT AND VACUUM PUMP FOR EFFECTING SAME

[76] Inventor: Marxen Petrovich Larin, prospekt Nauki, 29, kv. 78, Leningrad, U.S.S.R.

[22] Filed: Apr. 29, 1975

[21] Appl. No.: 572,915

[30] Foreign Application Priority Data

Apr. 30, 1974 U.S.S.R. ..... 2019987

[52] U.S. Cl. ..... 62/55.5; 55/269

[51] Int. Cl.[2] ..... B01D 5/00

[58] Field of Search ..... 62/55.5, 45, 55; 55/209, 269; 417/901

[56] References Cited

UNITED STATES PATENTS

| | | | |
|---|---|---|---|
| 3,144,756 | 8/1964 | Arnold et al. | 62/55 X |
| 3,188,785 | 6/1965 | Butler | 62/55.5 |
| 3,216,207 | 11/1965 | Boyer et al. | 62/55.5 |
| 3,360,949 | 1/1968 | Blanchard et al. | 62/55.5 |
| 3,379,132 | 4/1968 | Wagner | 62/55 X |
| 3,536,418 | 10/1970 | Breaux | 62/55 X |

*Primary Examiner*—William E. Wayner
*Assistant Examiner*—Ronald C. Capossela
*Attorney, Agent, or Firm*—Haseltine, Lake & Waters

[57] ABSTRACT

The invention relates to methods of producing a vacuum in a recipient and vacuum pumps for effecting same.

This method consists in the pressure within a recipient being lowered from the atmospheric pressure to an initial vacuum by preliminary evacuation of gases through a solid or liquid gas mass which congeals, when supercooled as a result of removal of its surface vapors, coincidental with the evacuation, the pressure being later brought to a high vacuum level. A baffle is placed in a vacuum pump chamber, dividing this chamber into two spaces, one connected to the recipient and the other to a preliminary evacuation system, wherein the baffle and one of the walls form a clearance, blocked by the liquid or solid gas mass. Such method and vacuum pump ensure production of a sterile oil-free vacuum from 760 mm Hg to $10^{-13}$ mm Hg and higher.

9 Claims, 8 Drawing Figures

METHOD OF PRODUCING VACUUM IN RECIPIENT AND VACUUM PUMP FOR EFFECTING SAME

The present invention relates to vacuum and cryogenic engineering as well as to cryophysics and, in particular, to methods of producing a vacuum in a recipient and a vacuum pump for effecting same.

The invention may most effectively be used to produce a sterile oil-free vacuum from 760 mm Hg to $10^{-13}$ mm Hg and higher in recipients ranging from several $dc^3$ to several $m^3$, employed in industrial vacuum deposition plants, electronic industry process lines, research in accelerators, thermonuclear fusion installations, space simulation devices and other apparatus wherever superpure high and ultrahigh vacuum in recipients is required.

The present-day methods of producing and maintaining a vacuum, especially a high or ultrahigh vacuum are far from satisfying the requirements of industrial production of superpure materials obtained in a vacuum, as well as requirements of researchers investigating certain fine physical phenomena and processes, whose experiments are to be run under ultrahigh and "sterile" (superpure) vacuum conditions. To create such conditions, both industry and science demand high-efficiency, oil-free vacuum production means, featuring high evacuation capacities, reaching several hundreds of thousands litres per second of all residual gases removed from a recipient, and high performance as to the extreme vacuum levels obtainable.

Known in the art are several methods and pumps for oil-free high and ultrahigh evacuation; these are methods and apparatus for multistage cryogetter evacuation, methods employing magnetodischarge, ionosorption pumps, turbomolecular pumps, liquid nitrogen, hydrogen and helium cryogenic pumps.

Also known are methods and apparatus utilizing prevacuum (or primary) and high vacuum diffusion pumps, wherein a recipient is protected against oil vapours, diffusing from working chambers of these pumps, with the help of various oil traps.

In our opinion, the most effective methods and means for producing a high or ultrahigh, as well as almost oil-free vacuum in a recipient are methods and means of cryocondensation and cryosorption evacuation (cf. British Patent No. 1,117,822 filed 1966 and No. 1,216,448 filed 1969, Cl. FIN).

These methods consist in the pressure in a recipient being first lowered from atmospheric pressure to an initial vacuum by preliminary evacuation of gases, then to a high and ultrahigh vacuum by cryosorption of the residual atmosphere in a recipient by a solid-state gas.

Vacuum pumps for effecting these conventional methods comprise a chamber, featuring cooled cryocondensation and cryosorption surfaces, connected to a recipient and a preliminary evacuation system. The cryocondensation surface is in fact a free-pendant vessel filled with liquid hydrogen or helium and shielded by liquid nitrogen cooled screens.

The conventional method and vacuum pump leave the residual atmosphere in the recipient insufficiently free of oil vapours because of inadequate means of proofing the recipient from oil vapours, leaking from the oil medium. The free-pendant vessel, disposed in the pump and filled with liquid hydrogen or helium, ensures but a partial condensation of the stream of gases, diffusing from the recipient and the preliminary evacuation system, precluding thereupon production of vacua higher than $10^{-10}$–$10^{-11}$ mm Hg. Besides, the cryopump, with its bulky structure, is complicated to operate and its specific evacuation capacity per unit weight is appreciably less than the possible maximum.

It is an object of this invention to eliminate the aforementioned disadvantages.

It is an object of this invention to provide a method of producing a vacuum in a recipient and a vacuum pump for effecting same, ensuring therewith production of a vacuum of the order of $10^{-13}$ mm Hg and higher in the recipient.

An important object of the invention is to provide an oil-free medium in the recipient when the aforementioned vacuum is achieved.

Another object of the invention is to provide a vacuum pump with a large specific evacuation capacity, to realize the proposed method.

A further object of the invention is to provide a vacuum pump which is easy to operate and reliable in service, to realize the proposed method.

These and other objects are achieved by producing a vacuum in a recipient by a method wherein the pressure in the recipient is first reduced from atmospheric pressure to an initial vacuum by preliminary evacuation of gases and later to a high and ultrahigh vacuum level by cryosorption of the recipient residual atmosphere with the help of a solid state gas, the preliminary evacuation of gases to the initial vacuum being done through a solid or liquid gas mass which congeals, when supercooled by removing surface vapours coincidental with the evacuation.

As a consequence of such a method, the air removed from the recipient first comes into contact with the liquid phase of a gas, e.g. liquid nitrogen and passes, or rather "bubbles" there through, a part of air components, such as water vapours, carbon dioxide, heavy hydrocarbons and a certain amount of argon, nitrogen and oxygen, being partially or completely condensed or sublimed upon contact with liquid nitrogen, whereas other air components, such as helium, hydrogen, neon, methane and carbon monoxide, with a condensation temperature below that of liquid nitrogen, passing freely through the liquid nitrogen mass and entering the evacuation zone of a mechanical fore pump.

Oil vapours, diffusing from the fore pump, come into contact with the cold mass of liquid nitrogen, sublime thereupon, their vapour pressure dropping very low, and thus find no access to the recipient. In this case, liquid nitrogen acts as a cryogenic liquid gate, letting gases non-condensable at the liquid nitrogen temperature out of the recipient to the preevacuation zone and barring easily condensable gases.

The removal of air components from the recipient is accompanied by evacuation of liquid nitrogen surface vapours, bringing its temperature below 77° K. When the pressure over the liquid nitrogen mass drops below 94 mm Hg, it starts solidifying and the temperature fails lower than 63° K, the solidifying gas mass turning into a finely porous fraction with porosity of the order of 10 or 15%, depending on the rate of vapour evacuation. Further evacuation goes on in this fashion and in a fairly short time the temperature of the already solidified nitrogen may be brought to 50°–45° K and lower, while the pressure in the recipient and over the solidified nitrogen surface is brought to approximately 1 mm Hg.

The solid nitrogen thus produced is a cold porous mass and acts as a good adsorption filter passing helium, neon, hydrogen to the evacuation zone and adsorbing by its mass all other gases with the exception of nitrogen itself, its pressure within the recipient being determined by the solid mass temperature and the vapour pressure over this mass, associated therewith.

As mass-spectrometer measurements indicate, the atmosphere in the recipient, obtained with the help of the aforementioned method at this stage, comprises nitrogen at a pressure of the order of 1 mm Hg and lower, the partial pressure of non-condensable gases (helium, neon, hydrogen) falling below $5.10^{-8}$ mm Hg.

A further increase of the vacuum may be achieved by any conventional means and methods of oil-free evacuation, but more effectively this process is conducted according to the invention, when the obtained solidified mass is cooled by a colder-than-the-mass refrigerant for cryosorption of the residual atmosphere in the recipient.

If liquid nitrogen, for example, is employed as the mass of liquid and later solidified gas, it is expedient to apply liquid or solid hydrogen at a temperature of 20°–10° K or liquid helium at a temperature of 4.2°–1.6° K as refrigerants.

The vapour pressure of solid nitrogen sharply drops with a decrease in temperature, whereas its sorption capacity to trap non-condensable gases rises.

Thus, the vapour pressure of liquid nitrogen (saturated vapour pressure) becomes $10^{-11}$ mm Hg at a temperature of 20° K, and it becomes an effective sorbent of residual hydrogen in the recipient (one hydrogen molecule being on the average sorbed by 100–1,000 solid nitrogen molecules). Whereas at a temperature of 4.2° K, the saturated vapour pressure of solid nitrogen reaches $10^{-77}$ mm Hg and, besides, it becomes an effective sorbent of the residual helium in the recipient (one helium molecule being on the average sorbed by 100–1,000 solid nitrogen molecules), let alone hydrogen and other gases.

The forementioned method permits production of vacua in excess of $10^{-13}$ mm Hg in a recipient, making use of solid nitrogen, for example, as a sorbent and liquid helium as its refrigerant.

Oil-free initial evacuation, according to the proposed method, may be followed by high vacuum exhaustion of the recipient, first, for instance, by a mechanical fore pump, then by a high vacuum diffusion pump through solidified carbon dioxide, cooled before high vacuum exhaustion by liquid and then solid nitrogen.

The inherent carbon dioxide vapour pressure at 77° K is $2 \cdot 10^{-8}$ mm Hg and at 47° K goes well below $10^{-8}$ mm Hg. Besides, the sorption capacity of solid carbon dioxide at temperatures from 77° K to 47° K (easily attainable with the help of liquid and solid nitrogen, employed here as refrigerants) is extremely high and it is an effective sorbent of practically all gases, except residual helium, neon and hydrogen.

However, in case the recipient is exhausted further on with the help of a diffusion pump, for example, through a carbon dioxide mass, cooled to 47° – 50° K by solid nitrogen, vacua in excess of $10^{-11}$–$10^{-13}$ mm Hg can be attained in the recipient, if the inherent maximum vacuum of the diffusion pump is of the order of $10^{-6}$–$10^{-8}$ mm Hg, respectively. It becomes possible due to the summary partial pressure of helium, neon, and hydrogen in the gas mixture of the residual atmosphere, sustained by the diffusion pump, being $10^{5}$–$10^{6}$ mm Hg lower than the partial pressure of other gases, that is, approaching $10^{-11}$–$10^{-13}$ mm Hg. As has been mentioned above, these other gases are effectively trapped by solid carbon dioxide at a temperature of 47°–50° K. Clearly, the maximum vacuum level achieved with the help of solid carbon dioxide cooled by solid nitrogen and a diffusion pump evacuating the recipient through solidified carbon dioxide, is determined by the diffusion pump input partial pressure of helium, neon and hydrogen only.

To carry into effect the foregoing method of oil-free vacuum production in a recipient, a vacuum pump comprising a chamber connected to the recipient and a preliminary evacuation system, in accordance with the invention, is provided with a baffle disposed in the chamber and dividing it into two spaces, one being connected to the recipient and the other, to the preliminary evacuation system, wherein said baffle forms a clearance with at least one of the chamber walls for said spaces to communicate, the clearance being blocked by a liquid or solid gas mass disposed on the chamber bottom.

In operation, when the recipient is pre-evacuated through, for example, liquid then solid nitrogen, care should be taken to keep said clearance permanently blocked by liquid or solid nitrogen throughout the evacuation cycle, lest oil vapours slip into the recipient from the preliminary evacuation system, although such an occurence is highly improvable. This may happen, however, due to viscous operating conditions of the entire preliminary evacuation period, wherein the free path of gas molecules, as well as oil vapours, is appreciably shorter, as compared to the geometric dimensions of the cold-walled manifold in the pump. Basically, therefore, oil molecules may slip into the recipient, striking evacuated gas molecules and escaping altogether the cold chamber wall of the vacuum pump, that is, the trap. Preliminary evacuation by such a pump involves a 2.7 g expenditure of liquid or solid nitrogen per one litre of air passing through its mass, the pressure being lowered from the atmospheric to 1 mm Hg. Besides, coincidental vapour evacuation of liquid, then solidified, nitrogen, disposed in said pump, results in a loss of almost 20% of the total amount placed in the pump.

The foregoing figures are to be taken into account for selection of an adequate amount of liquid nitrogen to be filled in a pump and a proper size of a pump to be connected to a recipient of a certain capacity.

It should be emphasized that the maximum initial vacuum level in a recipient, exhausted by a force pump through said vacuum pump, is determined basically by three factors:

1. the number of heat radiation and conduction inflows from pump parts to the enclosed liquid then solid nitrogen;

2. the evacuation capacity of the selected primary pump and transmissive capacity of connecting tubes and the porous mass;

3. the period required to reach saturation, wherein the rate of effective evacuation becomes equal to that of solid nitrogen vaporization due to whatever heat inflow it may have.

The optimum period to produce an oil-free vacuum of about 1 mm Hg of existing vacuum pumps of this type is 10–20 min. employing a mechanical fore pump with a capacity of 5 l/sec and filling about 1 kg liquid nitrogen into the vacuum pump.

Another embodiment of a vacuum pump, operating in accordance with said method, is used to produce high and ultrahigh oil-free vacuum in a recipient.

Unlike the previous embodiment, such a pump features a number of ribs attached to the chamber wall in the clearance zone, not lower than the clearance and optically overflapping it, the chamber, ribs and baffle being cooled by a refrigerant colder than a cryosorbent for more efficient reduction of temperature of the entire solidified mass acting as a cryosorbent.

When solid nitrogen, for example, reaches a temperature of 47°–50° K through vapor evacuation, it can be further cooled by, for example, liquid helium to a temperature of 4.2° K and lower. In consequence, the inherent vapour pressure of the nitrogen cooled to 4.2° K approaches $10^{-77}$ mm Hg and this solid state nitrogen is capable of sorbing all gases, including residual helium; thus, the vacuum in the recipient may become substantially higher than $10^{-13}$ mm Hg.

Structurally, this is achieved by arranging a coaxial-concentric trough around the chamber containing a cryosorbent in the pump, wherein a refrigerant is filled at a temperature lower than the cryosorbent temperature obtained by evacuation of its vapours. When solid nitrogen is used as a cryosorbent, it is more efficient to employ liquid or solid hydrogen or, still better, solid helium for cooling; in case carbon dioxide is used as a cryosorbent and liquid hydrogen or helium are not available, solid nitrogen at a temperature of 50° K and under may be employed for the purpose.

The proposed vacuum pump, operating on the forementioned principle, comprises, in accordance with the invention, a baffle dividing a chamber into two spaces communicating through a clearance, which is a cylindrical tube disposed vertically with a certain annular clearance from the chamber bottom, blocked by a liquid or solid gas mass of nitrogen or carbon dioxide, for example. Such an embodiment of said pump elements seems most rational and optimal in terms of convenience of parts fabrication, simplicity of production process and pump assembly, and efficiency of its operation.

Several ribs, made as perforated rings, are soldered, in accordance with the invention, to the chamber bottom of said pump 5 mm part from and coaxially with the clearance in order to achieve more rapid and efficient cooling of the cryosorbent to the temperature of the refrigerant and minimum temperature gradient upon the cryosorbent layers. These rings bring the temperature of the sorbent down rapidly and efficiently, make it equal all over the mass and, therefore, reduce drastically the time required for the sorbent to reach the temperature of the refrigerant. The fact is that the employed cryosorbents, like solid nitrogen, carbon dioxide and others, are poor heat conductors, especially nitrogen at a temperature below 35° K and carbon dioxide at 200° K. At such and lower temperatures, heat exchange under high and ultrahigh vacuum conditions in a solid cryosorbent mass through the gaseous phase is substantially reduced in contrast to such exchange in vapours at higher temperatures.

The forementioned rings used in this embodiment are specifically designed to drastically increase the rate of heat transfer from the cryosorbent to the refrigerant. The perforation of rings in the form of holes 3–5 mm in diameter with a distance of 10 mm between their centers, serves to improve convective heat exchange of the mass when it is still liquid, and gaseous heat transfer from the inner circular layers of the solid cryosorbent to its outer layers during its vapour evacuation effected outside the baffle.

The chamber space communicating with the recipient of the vacuum pump used wherein is solid nitrogen as the cryosorbent and liquid helium as the refrigerant, is, in accordance with the invention, shut off optically by a cryopanel soldered to the chamber and disposed above the cryosorbent, forming therein an enclosed volume sealed completely off any heat inflows from the recipient.

Solid nitrogen as well as other cryosorbents possess a very high degree of blackness, approaching E=0.9. At the same time, heat radiation from several tenths of a watt to several watts may penetrate into the cryosorbent zone from above even from a surface with the nitrogen temperature. Such radiation power turns out to be quite a fair amount to make the temperature of the upper cryosorbent layer substantially higher than the temperature of the refrigerant under steady-state conditions.

Besides, the forementioned panel, made as a section of herringbone louvres, which separates the inner chamber space with the cryosorbent from the recipient and has the temperature of liquid helium, condenses practically all gases, except for the residual helium and hydrogen, to some extent by its surface. It is only helium and hydrogen that penetrate to the cryosorbent and are efficiently sorbed therewith, and even a minor amount of the cryosorbent assures cryosorption of helium and hydrogen over a very long period of time of the order of several tens of thousands of hours.

Besides, liberation of gases in the recipient becoming comparatively abundant, there comes a point when the surface of the described panel condenses some $10^5$–$10^6$ monolayers of evacuated gases and conventionally designed cryocondensation pumps reach their saturation level, that is a pump ceases exhausting, the vacuum deteriorates drastically, and the pump requires warming-up and removal of the condensate.

Such a process is almost absent in the described embodiment of a cryocondensation-sorption pump, and the vacuum is maintained on the same level. This is due to the gas molecules, diffusing into the pump from the recipient, being able, after the cryopanel is saturated, to penetrate into the enclosed volume limited by surface with the temperature of liquid helium, wherein the cryosorbent is contained. The penetrated gas may condense within this volume on cold surfaces or adsorb upon the cryosorbent. As a result, the continuous run period of the vacuum pump, till it has to be warmed up, as compared to conventional embodiments, increases sharply.

For a better understanding of the invention, reference will now be made to specific embodiments thereof, taken in conjunction with the accompanying drawings, wherein.

Figure 1:
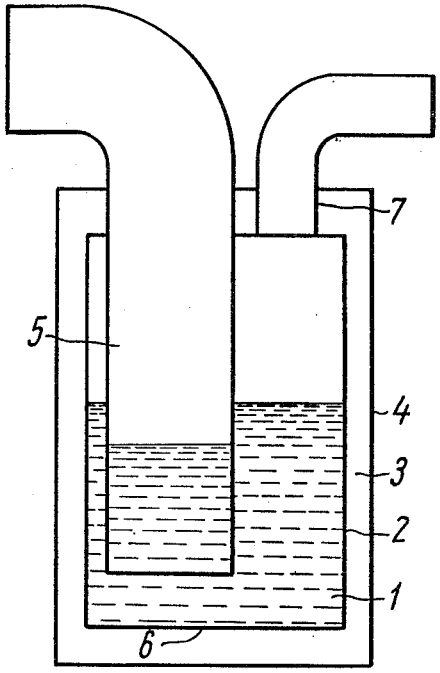
FIG. 1 is a schematic illustrating the proposed method of producing a vacuum in a recipient.

The essence of the proposed method of producing a vacuum in a recipient is as follows.

A certain mass of liquid or solid gas, for example, readily available, safe and cheap liquid nitrogen 1 (FIG. I) with a boiling point below 0° C, is filled into a vessel 2, surrounded by another vessel 4 with a vacuum clearance 3. A tube 5 is immersed into liquid nitrogen, its upper end being connected to a recipient, and its lower end almost touching a bottom 6 of the vessel 2, forming a circular clearance. It is expedient to open an outlet port somewhere in the far part of the recipient and to close the inlet port (not shown on FIG. I) immediately after the liquid nitrogen 1 is filled into the vessel 2. Liquid nitrogen evaporates intensively, being filled into the vessel 2 in the course of cooling, and a large amount of gaseous nitrogen is liberated (thus, each litre of liquid nitrogen forms almost 650 litres of gaseous nitrogen under atmospheric pressure and at a temperature of 0° C).

This gaseous nitrogen passes through the recipient and, as it leaves the latter, ventilates it on the way, blowing out most of the air components and enriching the recipient atmosphere with pure nitrogen.

When intensive boiling of the liquid nitrogen I in the vessel 2 ceases, the recipient outlet for nitrogen vapours is shut and evacuation starts immediately with the help of, for example, a mechanical fore pump from the volume over the surface of the liquid nitrogen 1 through a tube 7.

The liquid nitrogen 1 level in the vessel 2 goes up because of the pressure over its surface dropping as the evacuation of its vapours begins, whereas the level of liquid nitrogen in the tube 5 goes down, because of the pressure over liquid nitrogen in the vessel 2 falling below the gas mixture pressure in the recipient.

There comes a moment at a certain gas pressure drop when the liquid nitrogen level in the tube 5 reaches the lower end of this tube and a part of the gas mixture forces its way through the liquid nitrogen 1 and tube 5, coming to its surface. On their way, some gases of this mixture partially condense in liquid nitrogen (nitrogen, oxygen, argon), transferring a part of their thermal energy therein, other gases (water vapours, carbon dioxide) sublime, turning into tiny snow-like solid particles, and some gases (helium, hydrogen, neon) pass freely through the liquid nitrogen mass.

All gases, breaking onto the surface of the liquid nitrogen 1 in the vessel 2 along with liquid nitrogen vapours, are evacuated by a primary pump through a tube 7.

Gradually, as evacuation goes on, the pressure over the liquid nitrogen surface and in the recipient drops, the temperature of liquid nitrogen comes down and, starting from a pressure of 94 mm Hg, a crust of solidified nitrogen begins to form on the surface of liquid nitrogen, being broken therewith by rising bubbles of the evacuated gas from the tube 5. As a result, a porous, mixing, snow-like mass of solidified nitrogen appears and grows downward until it finally turns into a whole porous mass criss-crossed by multiple fine capillaries by varying the evacuation rate of the primary pump, the mass can easily be imparted a 10–50% porosity. The porous solidified nitrogen is an excellent filter-adsorbed capable of trapping by condensation, sublimation and adsorption practically all gases, with the exception of helium, hydrogen, neon and nitrogen itself to a certain extent, which are easily filtered through a solid porous nitrogen mass and carried away by the primary pump.

Thus, in the case of operation on liquid nitrogen, the latter acts as a hydraulic gate, whereas during solid nitrogen operation its mass becomes an excellent filter-adsorber with a very low temperature of 63° or 45° K and under.

Oil vapours, diffusing from the mechanical pump through the tube 7 into the vessel 2, sublime at once on encountering the surface of the liquid nitrogen I and acquire a very low vapour pressure, which quite evidently prevents them from getting into the recipient through the tube 5.

This is the most efficient way of producing an oil-free vacuum of the order of 1 mm Hg in the recipient, wherein the residual atmosphere is practically all nitrogen and the total partial pressure of helium, neon and hydrogen keeps on a level below $5 \cdot 10^{-8}$ mm Hg.

The proposed method can be carried into effect with the help of a vacuum pump comprising a chamber 8 (FIG. 2) connected to the recipient by a flange 9. The chamber 8 is divided into two spaces, an outer space 11 and an inner space 12, by a cylindrical baffle 10 with an annular clearance 14 along the perimeter of said baffle 10 and a bottom 13 of the chamber 8. This clearance is filled by a mass of liquid or solid gas, for example, liquid nitrogen, which is to become a cryosorbent 15. The cryosorbent is disposed on the bottom 13''. The chamber 8 is surrounded by a trough 16 with, for example, liquid helium, provided with a cover 17, the upper edge of the baffle 10 being soldered vacuum-tight to its under face 18. The outer space 11 of the chamber 8 communicates with the atmosphere by means of a tube 20, running through an upper face 19 of the cover 17 of the trough 16 and used to fill in the future cryosorbent 15, liquid nitrogen for example, into the chamber 8. A tube 21 serves to exhaust the recipient through liquid nitrogen and coincidental evacuation of nitrogen vapours. The future cryosorbent 15 is poured in the annular outer space 11 through the tube 20 so that its level is equal to twice or thrice the height of the clearance 14. Liquid helium is poured into the trough 16 through the tube 22 and evacuation of its vapours is effected, if necessary, through a tube 23.

The trough 16 is protected against outside heat sources to avoid waste of liquid helium by another trough 24 with liquid nitrogen to be poured through a tube 25 and its temperature to be reduced as needed by evacuation of vapours through a tube 26 from under a cover 27 of the trough 24. A blackened herringbone cryopanel 29 with a temperature of liquid nitrogen, providing an optically tight sealing of the chamber 8 from heat radiation inflows from the recipient side, is soldered to an under face 28 of the cover 27 of the trough 24, securing a good heat contact therewith. On the outside, the trough 24 is enclosed by an outer casing 30 of the vacuum pump.

Figure 3:
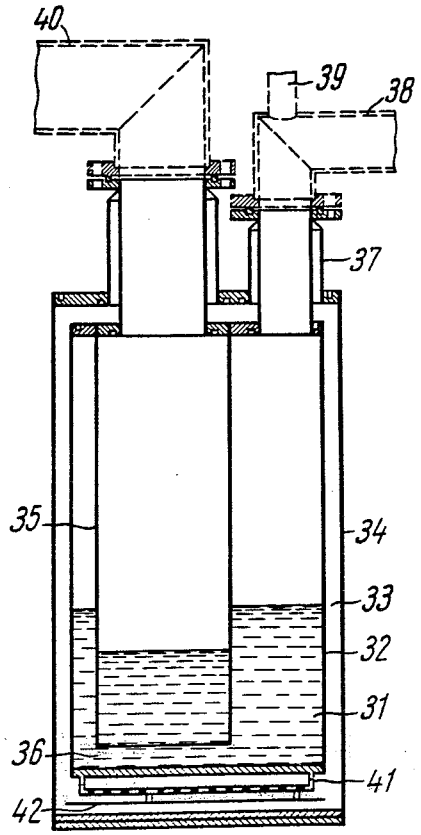
FIG. 3 shows a vacuum pump wherein solid nitrogen is used as a gas mass.

Referring now to FIG. 3, the vacuum pump shown therein comprises liquid nitrogen 31, used as a mass of liquid or solidified gas functioning as a cryosorbent, disposed in a cylindrical vessel-chamber 32. This chamber is enclosed by an outer casing 34 with a vacuum gap 33. A tube 35 is immersed into the chamber 32, dividing the volume of the chamber 32 into an outer and an inner spaces, the lower end of the tube 35 almost reaching the bottom of the chamber 32 with an annular clearance 36 along the tube perimeter. At the top, the vessel-chamber 32 is provided with an outlet through a tube 37 wherein a connection tube 38 makes the chamber space 32 to communicate with a fore pump. A tube 39 serves to pour liquid nitrogen into the chamber 32. The connection of the vacuum pump to the recipient is effected through a tube 40. Substantial reduction of heat radiation inflows to liquid and solid nitrogen in the chamber 32 is achieved by that the outer surface of this chamber and the inner surface of the casing 34 is thoroughly polished and the gap 33 exhausted to a pressure of $10^{-6} - 10^{-7}$ mm Hg. In order to maintain such a vacuum in the gap 33 (for several years), a case 41 containing an adsorbent and shielded from the pump casing bottom by a polished screen 42 is soldered to the bottom of the chamber 32. The adsorbent, such as activated charcoal, sorbs the residual gas from the gap 33 as it cools right after filling of the liquid nitrogen 31 in the chamber 32 through the tube 39.

Figure 4:
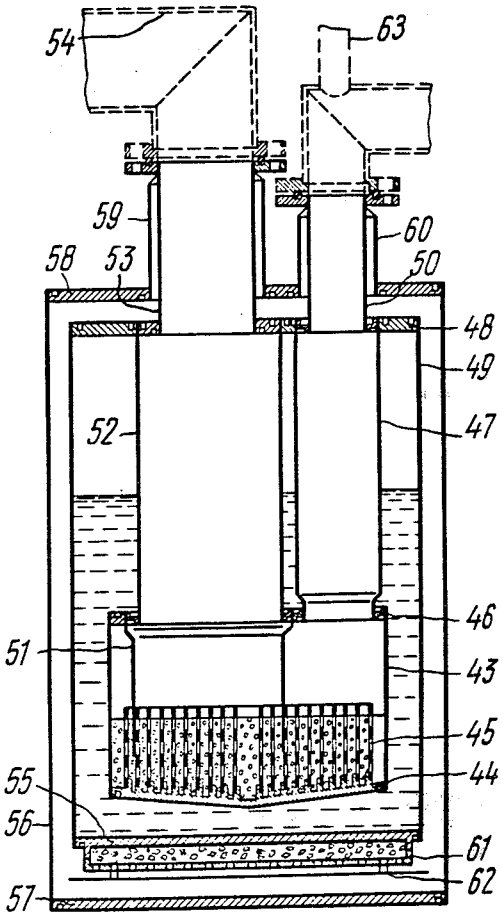
FIG. 4 shows another embodiment of a vacuum pump, wherein solid carbon dioxide is used as a gas mass.

Turning now to FIG. 4, the vacuum pump shown therein contains solid carbon dioxide as a cryosorbent and is designed to produce an ultrahigh vacuum in recipients with a volume of several $dc^3$ and minor gas liberation. This pump comprises a chamber 43 with a copper bottom 44, several coaxial ribs 45 made as copper perforated rings soldered thereto 3–5 mm apart. A tube 47 is vacuum-tight soldered to a top cover 46 of the chamber 43 and connected to a top cover 48 of a vessel 49 containing first liquid then solid nitrogen. The tube 47 extends to a thin-walled stainless steel tube 50 coupling the chamber 43 to a high-vacuum pump, e.g. of a diffusion or turbomolecular type (not shown).

A tube 51 is immersed into the chamber 43, forming a certain clearance with the ribs 45 and the bottom 44, and associated with the cover 46 and a tube 52 connected to a thin-walled tube 53 through the cover 48 of the vessel 49. The tube 53 couples the inner space of the chamber 43, limited by the tube 51, to the recipient through a connection tube 54. Below, the vessel 49 terminates in a bottom 55, and an outer casing 56 has a bottom 57. A top cover 58 of the casing 56 carries the vessel 49 secured by tubes 59 and 60. A case 61 with a perforated bottom is soldered to the bottom 55 of the vessel 49, wherein an adsorbent, activated charcoal for example, is disposed upon a fine-mesh net, serving to maintain a high vacuum in the gap between the vessel 49 and the casing 56. All surfaces adjacent to the vacuum gap are thoroughly polished. The case 61 is protected against radiated heat from the bottom 57 by a polished screen 62. The chamber 43 is filled with gaseous or solid carbon dioxide by a tube 63.

Figure 5A:
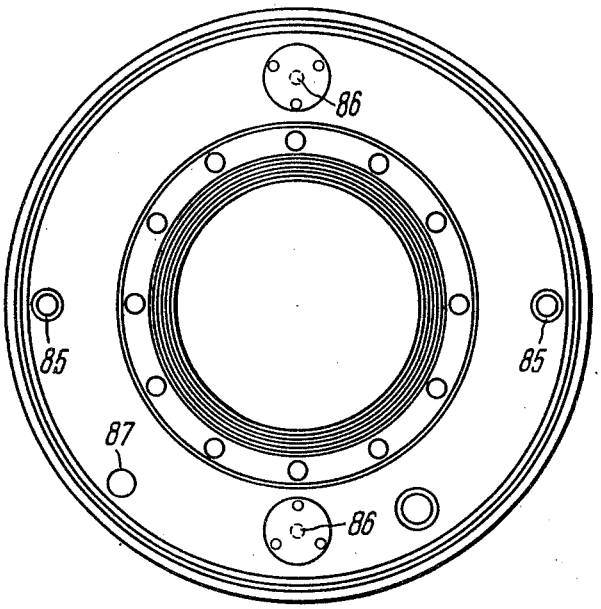
FIG. 5a is a top view of FIG. 5.
Figure 5:
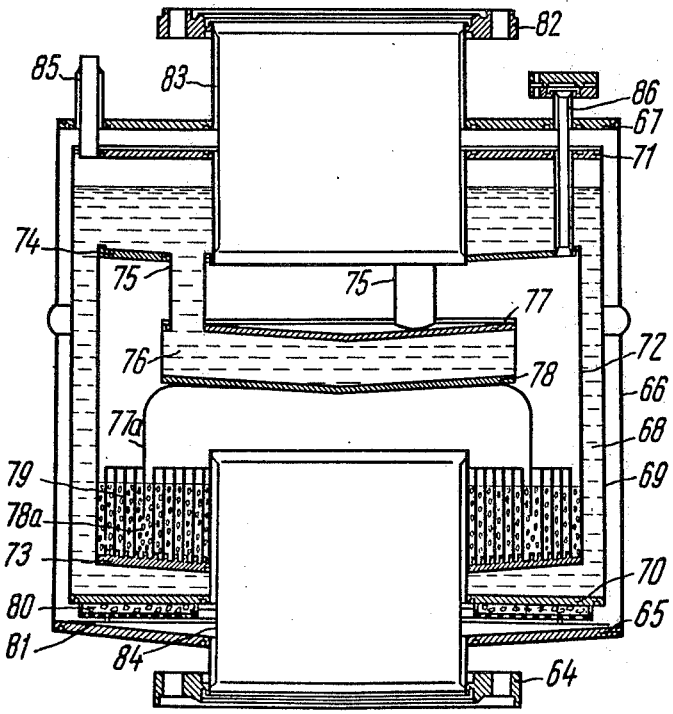
FIG. 5 shows still another embodiment of a vacuum pump.

The vacuum pump illustrated in FIGS. 5 and 5*a* uses solid carbon dioxide as a cryosorbent and is designed for producing an ultrahigh vacuum in the recipient with a volume from several $dc^3$ to several $m^3$ and moderate gas liberation. This pump is constructed so that in the course of exhausting the recipient by a high-vacuum preliminary evacuation system, such as a diffusion or turbomolecular pump, its gaseous conductivity is not lower than the rate of evacuation of these gases.

The pump comprises a bottom flange 64 (FIG. 5), featuring a metal packing for coupling to, for example, an oil-diffusion pump with a maximum vacuum capacity of the order of $10^{-5}$–$10^{-9}$ mm Hg and an evacuation rate of 100–8,000 l/sec. A bottom 65 of a pump casing 66 is soldered to this flange 64 and a top cover 67 is soldered to the casing 66. The casing 66 holds a vessel 68 filled with liquid nitrogen, and its outer surface 69 is thoroughly polished in the same manner as the inner surface of the casing 66. A bottom 70 and an annular top cover 71 are soldered to the casing 69 of the vessel 68.

From below, a copper bottom 73 is soldered to an inner wall of the vessel 68 and, from top, a cover 74 is soldered thereto, carrying a screen-trough 76 with a cover 77 and a bottom 78 secured on three tubes 75. A copper baffle 77*a*, made as a cylindrical rim, is soldered to the bottom 78 almost reaching the bottom 73 and forming an annular clearance 78*a* along the perimeter of the baffle 77*a*. The bottom 73 carries coaxially soldered perforated copper cylindrical rings 79, spaced 5 mm apart, designed for efficient heat removal from the cryosorbent such as carbon dioxide to the bottom 73 then to liquid then solid nitrogen placed in the vessel 68. A case 80 with an adsorbent is soldered to the bottom 70 of the vessel 68 and separated from the bottom 65 by a polished screen 81. The adsorbent is employed to maintain a vacuum of no less than $10^{-5}$ mm Hg for a period of several years in the gap between the vessel 68 and the casing 66 of the pump, the adsorbent starting to increase the vacuum level in the gap immediately after liquid nitrogen is poured into the vessel 68. The once-exhausted vacuum gap is intended for reduction of heat inflows to the refrigerant and the cryosorbent, while the diffusion pump is cut off.

The top portion of the pump carries a soldered flange 82 featuring a metal packing for coupling the pump to the recipient. From top the vacuum gap between the casing 66 and the vessel 68 is separated from the inner space of the pump by a thin-walled cylindrical rim 83, soldered from below to the cover 74 and from above to the flange 82, and from the underside the gap is shielded by a thin-walled rim 84, soldered from below to the flange 64 and from above to the bottom 73.

Pouring of liquid nitrogen into the vessel 68 and evacuation of its vapours are effected by means of one of the two tubes 85, whereas filling of gaseous or solid carbon dioxide, by means of the tubes 86 (FIG. 5).

Exhaustion of the gap between the vessel 68 and the casing 66 is done through a filler 87 once in several years.

Figure 6:
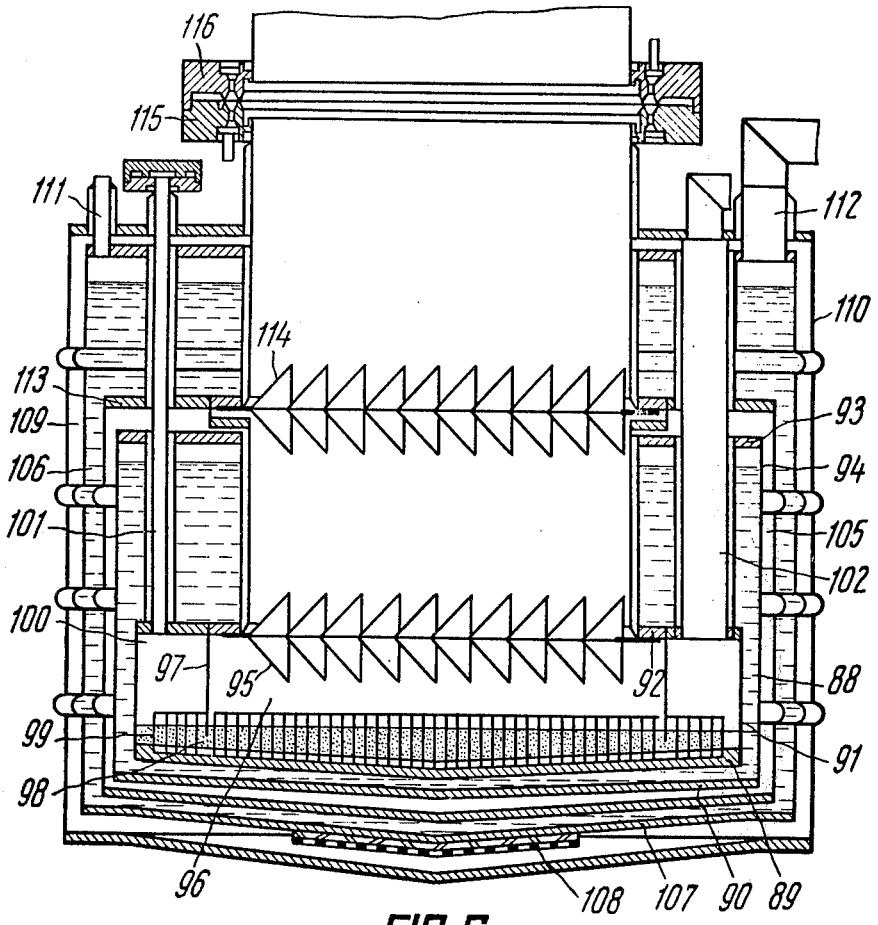
FIG. 6 is a longitudinal sectional view to a third embodiment of a vacuum pump, wherein a cryopanel is disposed in the pump chamber.
Figure 7:
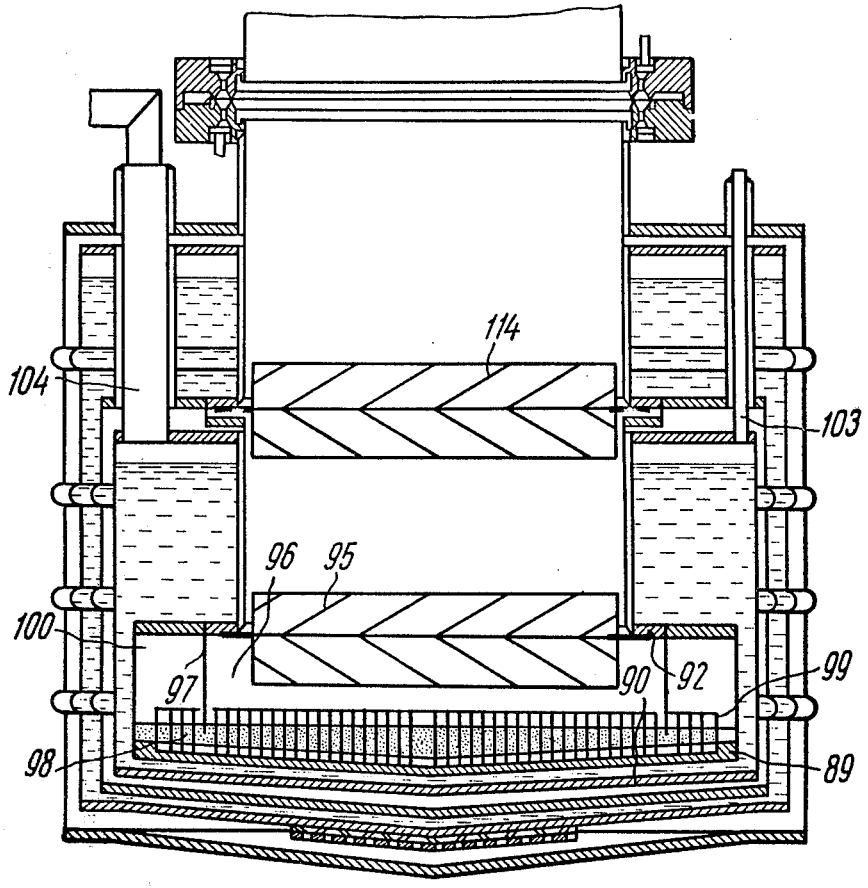
FIG. 7 is a side view of FIG. 6.

The ultrahigh-vacuum helium pump illustrated in FIGS. 6 and 7 is designed for producing an ultrahigh oil-free vacuum from 760 to $10^{-13}$ mm Hg and upwards both with the help of primary means of preliminary evacuation (when exhausting recipients with a volume from several hundreds to several $m^3$) and directly from the atmospheric pressure (when exhausting recipients with a volume from several tens to several hundreds $dc^3$).

This pump comprises a vessel 88, filled for operation with liquid helium, for example, featuring a copper tray 89 and a floor 90, an inner wall 91, copper covers 92 and 93, and an outer wall 94. An optically tight blackened herringbone cryopanel 95 is soldered to the cover 92 to shield a space 96 from heat radiation at temperatures ranging from 77° K to 4.2° K.

A baffle 97, made as a copper cylindrical rim, is soldered to the cover 92 almost touching the tray 89 and forming an annular clearance along its perimeter.

Coaxial ribs 99, made as cylindrical rims spaced some 5 mm apart, are soldered to the tray 89. The ribs are of high-quality sheet copper and their surface is perforated by holes having a diameter of 3–5 mm and with a distance of 8–10 mm between their centers, the height of the ribs 99, especially those in the area of the baffle 97 and the clearance 98, exceeding that of the clearance.

Thus, the components 89, 91, 92, 95, 97 and 99 form an enclosure shielded on all sides by surfaces with the temperature of liquid helium, this enclosure being divided by the baffle 97 into two spaces: an inner space 96 and an outer space 100. The inner space 96 communicates with the recipient by a molecular flow through the cryopanel 95, optically impenetrable for the heat radiated from the recipient. The outer space 100 has two outlets beyond the pump, one through a tube 101, serving to fill liquid nitrogen, for example, into the space 100, later flowing through holes in the ribs 99 and the clearance 98 into the space 96, and the other through a tube 102, serving to pump out vapours of liquid then solid nitrogen from the spaces 96 and 100, as well as to coincidentally evacuate gases from the recipient through a solid nitrogen mass.

A tube 103 (FIG. 7) is intended for filling liquid helium into the vacuum pump and a tube 104 for letting liquid helium vapours out during filling and for their evacuation by a fore pump to bring the liquid helium temperature down to 1.6° K, if required.

For drastic reduction of the heat flow caused by molecular heat exchange and radiation directed to the vessel 88 (FIG. 6), a trough 106 with liquid nitrogen is arranged coaxially and concentrically around it with a vacuum gap 105, a case 108, containing an adsorbent, soldered to a trough floor 107 to maintain, for a long time (several years), a vacuum not lower than $10^{-5}$ mm Hg in the gap. This vacuum gap 105 communicates with a vacuum gap 109 between an outer casing of the trough 106 and an outer casing 110 of the vacuum pump itself. Liquid nitrogen is filled into the trough 106 through a tube 111, whereas discharge and evacuation of its vapours is effected, if need be, through a tube 112. A top cover 113 of the trough 106 carries a cryopanel 114 soldered thereto and similar to the cryopanel 95, that is performing the same function but at a temperature level of 300° K–77° K.

On top, the vacuum pump is provided with a flange 115 with a metal packing coupled to a flange 116 of the recipient.

This pump is designed and manufactured for various ultra high vacuum applications. It may be successfully employed in industrial installations for melting metals under superpure conditions, growing single crystals of refractory metals, and in deposition plants to manufacture microelectronic components.

Besides, this pump may be successfully used in space simulation devices for studying a highly diluted hydrogen plasma at a partial hydrogen pressure from $10^{-7}$ mm Hg and lower, because the temperature of the cryopanel 95, bottom 89 and ribs 99 in the pump can be brought down to 1.6° K by helium vapours evacuation. The evacuation capacity of this pump reaches 5,000 l/sec, the weight is about 100 kg, the outer diameter 530 mm, height 520 mm. Liquid helium expenditure under steady operating conditions is 0.3 l/hr, the capacity of the helium trough is 14 l, liquid nitrogen expenditure is 0.6 l/hr, the nitrogen trough capacity is 22 l.

Figure 2:
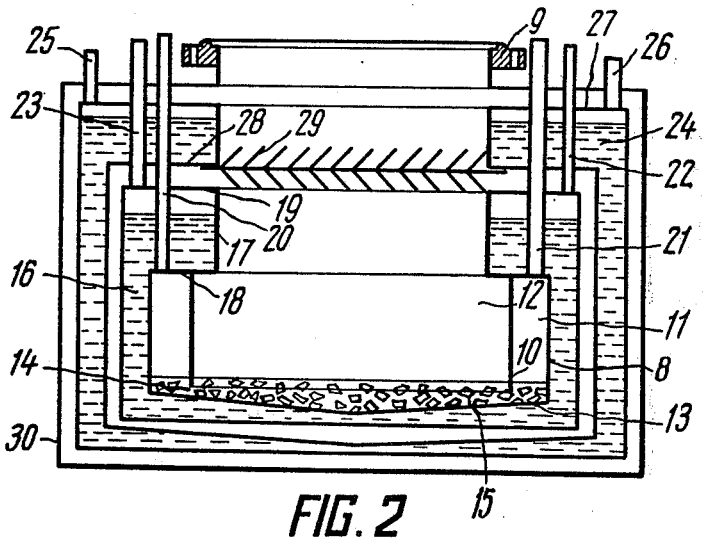
FIG. 2 is a schematic of a vacuum pump for effecting same.

The proposed method of producing an oil-free and ultrahigh vacuum with the help of the pump illustrated in FIG. 2 is effected as follows.

Liquid nitrogen is first poured into the annular space of the chamber 8 through the tube 20, the recipient outlet being opened in advance to discharge nitrogen vapours. Liquid nitrogen flows into the space 12 from the space II through the clearance 14 under the baffle 10. The bottom of the chamber 8 cooled, intensive boiling of liquid nitrogen ceases thereupon and exhaustion is started through the tube 21 by, for example, a fore pump the tube 20 having been shut off.

The evacuation process at this stage is analogous to the method of producing an oil-free vacuum described above. Immediately on reaching a pressure of several mm Hg in the recipient, liquid nitrogen is poured into the trough 24 through the tube 25, then filling of the trough 16 with liquid helium is started through the tube 22, the preliminary evacuation of solid nitrogen vapours having been stopped. As solid nitrogen cools, the vacuum in the inner space of the pump begins to rise and may, for example, reach $10^{-13}$ mm Hg and higher in 2–4 hours after the pump activation, the recipient being completely shut off.

The nitrogen temperature in the trough 24 is lowered to 50° K–55° K by its vapours evacuation through the tube 26, with the opening in the tube 25 being closed when a recipient is exhausted to an ultrahigh vacuum level, wherein liberation or inlet of such gases as carbon dioxide takes place, or to reduce vaporization of liquid helium as well with a view to saving it.

In case the atmosphere exhausted from recipient is rich in hydrogen, the liquid helium temperature in the trough 16 is brought down to 1.6° K–1.8° K, its vapours evacuating being through the tube 29, the tube 22 having been cut off.

The operating conditions in accordance with the method disclosed herein may be altered to a certain extent to speed the process up, if the recipient volume is comparatively small (several tens of $dc^3$) and liquid helium need not be economized. Liquid nitrogen is not poured into the space 11 at all for the purpose, but is filled into the trough 24 then liquid helium is charged into the trough 16. As liquid helium gains access to the bottom of the trough 16, the gases in the recipient are condensed and sublimed on this bottom, forming layers of a sorbent with an extremely small inherent vapour pressure.

Should the need arise to increase the cryosorbent mass on the bottom 13, the valve on the tube 21 is somewhat opened and air or, better, gaseous nitrogen is let into the space 11 and 12, wherein, subliming on surfaces with the liquid helium temperature, or adds to the amount of the adsorbent to sorb gaseous hydrogen and helium diffusing from the recipient.

Activation of the vacuum pump operating on solid nitrogen and illustrated in FIG. 3 to produce an oil-free initial vacuum is effected in the following way.

The pump is coupled with the help of the tube 38 to, for example, a mechanical fore pump, and the tube 40 is connected to the recipient. Liquid nitrogen is poured through the tube 39 into the chamber 32, vapour outlets in the tube 40 and the tube 38 (not shown) previously opened. It is better to open a vapour outlet in the recipient, if it is available, the outlet of the tube 40 being then cut off.

As the internal parts of the cryopump are being cooled from room temperature to the temperature of liquid nitrogen during filling, intensive boiling of liquid nitrogen takes place and a large amount of gaseous nitrogen is released. This nitrogen should advisably be used for blowing the recipient and to this end, as has been mentioned above, it is expedient to open the outlet in the recipient without opening the outlet of the tube 40.

The chamber 32 is filled then by liquid nitrogen to the required level and its intensive boiling ceases, whereupon all vapour outlets are shut, as well as the tube 39, the fore pump is activated and evacuation is started first slowly, then at an increasing rate by gradual opening of the valve cutting the tube 38 from the fore pump.

The pressure in the recipient and over liquid nitrogen reaches 0.5–0.3 atm in 3–5 min, then the forementioned valve may be fully opened and evacuation continued at a maximum rate. In 10–20 min, the pressure in the recipient is worked down to 1–5 mm Hg and its further reduction becomes more slower. On reaching the required vacuum level, the valve coupling the tube 40 with the recipient is closed and further evacuation is effected by high or ultrahigh evacuation means.

The cryopump shown in FIG. 3 may be employed to exhaust the recipient with solid nitrogen filled in the pump beforehand, that is all forementioned operations are done with the valve between the recipient and the tube 40 first closed and opened later, when nitrogen is already solidified. The vacuum pump with solid nitrogen may be used in this or other way for 1–2 days, until refilling of liquid nitrogen is required, for continuous or interrupting evacuation, the pump of this design with a capacity of the chamber 32 about 1.5 liters being able to evacuate 0.3 $m^3$ of air and more from the atmospheric pressure to a pressure of 1 mm Hg.

For multiple but not frequent evacuation cycles (once in 1–2 days), the pump may be warmed up and regenerated or regenerated without warming-up. Each 10–15 warm-up and regeneration cycles, it is advisable to wash the inner space of the pump with gasoline, acetone or alcohol to remove even small quantities of pre-vacuum oil accumulated on the bottom and inner walls of the pump due to diffusion from the fore pump and its sublimation upon solid nitrogen.

The solid nitrogen vacuum pump illustrated in FIG. 4 and intended for ultrahigh vacuum production operates as follows.

The tube 54 is connected to the recipient, the tube 50 is associated with the diffusion pump, and solid carbon dioxide (if solid-state carbon dioxide is used) is filled into the chamber 43 through the tube 63. The tube 63 is then shut and initial evacuation of the recipient is started through the tubes 54, 52, 51, the chamber 43, the tubes 47 and 50, and the diffusion pump. Upon reaching a pressure of the order of 1 mm Hg, liquid nitrogen is filled into the vessel 49 and the diffusion pump is accelerated. The vacuum in the pump grows progressively and reaches $10^{-5}$–$10^{-7}$ mm Hg even before the boiler of the diffusion pump is heated up.

As soon as the diffusion pump starts pumping, solid carbon dioxide is to be cooled to 47° K–50° K by liquid then solid nitrogen, evacuating nitrogen vapours through a tube from the vessel 49.

After solid carbon dioxide has been cooled to 47° K–50° K, the vacuum in the recipient becomes 4–5 orders of magnitude higher than the vacuum the diffusion pump is capable of producing. Thus, making use of a conventional diffusion pump with a maximum vacuum of $10^{-6}$–$10^{-7}$ mm Hg evacuating a recipient through the proposed vacuum pump, it is possible to reach a vacuum of the order of $10^{-10}$–$10^{-11}$ mm Hg, and, making use of an ultrahigh vacuum diffusion pump with a maximum vacuum of $10^{-8}$–$10^{-9}$ mm Hg, it becomes possible to reach a vacuum of $10^{-12}$–$10^{-13}$ mm Hg, respectively, and even higher, the residual gas in the recipient containing basically 80–95% hydrogen, as mass-spectrometer examinations indicate.

The proposed cryopump may be employed without solid carbon dioxide if the recipient is previously exhausted by the pump illustrated in FIG. 3.

The pump shown in FIG. 4 is capable of uninterrupted operation for 2 days without refilling solid nitrogen in the vessel 49 and after nitrogen has been refilled through the tube 63 operation may continue. The vacuum produced by the pump drops 2–3-fold in the course of refilling and evacuation, but later is restored. Besides, evacuation by the cryopump and vapour exhaustion by a fore pump may be stopped at the end of the working day for the night and resumed in the morning after. By morning, the vacuum level in the recipient falls to $10^{-7}$–$10^{-5}$ mm Hg, but soon, within 10–15 min, is restored to the previous level immediately after the diffusion pump is heated up, the valve coupling it to the vacuum pump is opened and solid nitrogen vapours are exhausted to a pressure of the order of 1 mm Hg.

The rate of evacuation of this pump is determined, basically, by conduit capacity of the connecting tubes and lies in the range of several l/sec. This pump is successfully used for exhausting small heated volumes of several $dc^3$, glass unsoldering devices in radioelectronic industry, etc.

The operation of the solid carbon dioxide ultrahigh vacuum pump cooled by solid nitrogen, shown in FIG. 5, is in principle little different from the operation of the cryogenic pump illustrated in FIG. 4.

First, the cryopump space, communicating with the recipient, is exhausted, as well as the recipient itself, to the initial vacuum of the order of 1 mm Hg or lower with the help of oil-free evacuation means, such as shown in FIG. 3, keeping closed the valve, cutting off a diffusion or turbomolecular pump coupled by this valve to the cryopump from below with the flange 64. The diffusion pump is activated at the same time. Then, liquid nitrogen is poured into the vessel 68 through the tube 85 slightly over the level of the copper bottom 73 at first, and gaseous carbon dioxide is thereupon filled into the pump space in required amounts through the tube 86. Carbon dioxide is sublimed upon the surfaces of the rings 79 and the upper part of the bottom 73, having a temperature of 77° K, and acquires inherent vapour pressure of no more than $10^{-7}$ mm Hg.

Then the valve between the vacuum pump and the already started but idling diffusion pump is opened and in several minutes the vessel 68 is filled with liquid nitrogen to capacity.

Exhaustion of liquid nitrogen vapours is started thereupon from the vessel 68 through the tube 85. The vacuum in the recipient increases progressively and becomes 4–5 orders higher than the vacuum produced by the diffusion pump alone. Thus, the proposed vacuum pump is capable of producing a vacuum of the order of $10^{-12}$–$13^{-13}$ mm Hg and higher in a recipient with the help of a heated ultrahigh vacuum diffusion pump with an intrinsic maximum vacuum level of $10^{-8}$–$10^{-9}$ mm Hg.

The vacuum pump may be operated without filling carbon dioxide therein, if the residual atmosphere is not required to be strictly free of oil. The design arrangement of the components 77, 79 and the clearance 78*a* with the temperature of the rings 79 and the bottom 73 kept at 47° K–50° K offers a means to maintain a pressure drop of 4–5 orders of magnitude between the space inside the baffle 77*a* and its outside space at the expense of the condensate cryocondensation and cryosorption effects only.

Exhaustion of the recipient by the proposed vacuum pump is efficient with a continuously operating diffusion pump, but the latter may be cut off from the vacuum pump by a valve and the vacuum level eventually lowered, while accumulation of predominantly hydrogen and to a lesser degree helium and neon takes place in the recipient.

It is required in a week-long evacuation cycle, for example, to close at the end of the working day the valve between the cryogenic pump and the recipient, of available, as well as the valve over the diffusion pump, switch the latter out, stop exhaustion of nitrogen vapours from the vessem 68 by switching the tube 85 over to the safety valve and cutting off the fore pump for exhausting these vapours. Solid nitrogen in the space of the vessel 68 starts warming up and by morning melts and acquires the temperature of liquid nitrogen of 77° K. The vacuum level in the cryopump and the recipient, if it is not disconnected by a valve, drops by morning to $10^{-6}$–$10^{-5}$ mm Hg.

In the morning, the diffusion pump is started and, on reaching the operational regime, the valve, coupling it to the cryopump, is opened. In several minutes, the vacuum in the space of the cryopump is restored from $10^{-5}$ to $10^{-7}$ mm Hg and, if the recipient vacuum is lower (in case the recipient was cut off by the valve), the valve between the cryopump and the recipient is opened and the latter is exhausted to the same vacuum level. The forementioned valve is kept closed, if the vacuum level in the recipient is over $10^{-7}$ mm Hg.

Liquid nitrogen is thereupon refilled into the vessel 68 to capacity and evacuation of nitrogen vapours starts as the day before. In 20–40 minutes, the vacuum level, reached by the end of the previous day, is restored.

The nitrogen contained in the vessel 68 is sufficient for two days of uninterrupted operation without refilling.

Starting and operation of the helium ultrahigh vacuum pump shown in FIGS. 6 and 7 is effected in several regimes, depending on the evacuation conditions, recipient capacity, level of gas liberation therein and kind of gas prevailing in the evacuated mixture.

1. The following procedure is used to start the proposed vacuum pump, wherein the recipient cubic content is more than several hundreds of $dc^3$ and an ultrahigh oil-free vacuum is to be produced therein, with the vacuum pump being directly coupled to the recipient without a shut-off valve.

Liquid nitrogen is filled through the tube 101, the outlets for vapours discharge in the recipient and in an initial vacuum conduit, connected to the tube 102, being opened in advance. The in-pouring liquid nitrogen boils intensively, until the tray 89 is cooled to the nitrogen temperature, and liberates a large amount of dry and pure gaseous nitrogen, passing through the recipient and blowing it on the way by expelling and replacing the air.

On cooling of the tray 89 and the ribs 99 to the temperature of liquid nitrogen, it is filled into the space 100 and 96 correspondingly to a much higher level, as compared to the height of the clearance 98. The quantity of liquid nitrogen to be chosen depends on the recipient capacity. The filler to the tube 101 is then closed, as well as the vapour outlets in the recipient and the initial vacuum conduit, and exhaustion of the recipient is started by a mechanical fore pump, for example, through a mass of liquid nitrogen filled in the space 96.

The pressure in the recipient and the nitrogen vapour pressure coming down to 0.1 atm, liquid nitrogen is filled into the trough 106 through the tube 111, resulting in appreciable reduction of heat inflow to the chamber with the spaces 100 and 96, and further evacuation of the recipient and vapours of first liquid then solidified nitrogen brings the pressure down to 1–10 mm Hg. Simultaneously, preparation for filling liquid helium into the vessel 88 is under way.

Liquid helium is then started to be filled through the tube 103, letting the vaporizing helium out through the tube 104. Almost immediately after the beginning of helium filling, preliminary evacuation of nitrogen vapours and exhausting of the recipient are discontinued by closing the tube 102 and switching the primary pump out.

As liquid helium appears and accumulates in the vessel 88, solid nitrogen cools down 47°–50° K and a sharp increase of a vacuum to $10^{-9}$–$10^{-11}$ mm Hg occurs (if the pump is idling or the recipient gas liberation is very weak). Further increase of the vacuum goes much slower and it is in few hours or tens of hours only that it may reach the level of $10^{-13}$ mm Hg and higher.

2. The pump illustrated in FIG. 3, used as a preliminary stage of initial evacuation eliminates the necessity for liquid nitrogen filling into the spaces 100 and 96, and the pump can be quicker brought to the maximum vacuum regime at a lesser expenditure of liquid helium. To this end, the pump shown in FIG. 3 is coupled to the tube 102. Under such operating conditions, the quantity of solid nitrogen, turned into a cryosorbent and disposed in the tray 89 as a result of sublimation from the gaseous phase of the residual atmosphere, produced by the fore cryopump shown in FIG. 3, may be found inadequate for a lengthy period of sorption of residual helium and hydrogen to a certain extent. To avoid this, the valve on the tube 102 is slightly opened and a required amount of atmospheric air or better gaseous nitrogen or carbon dioxide is let in at a rate of 0.3 normal liters per minute. Care must be taken therewith to avoid reduction of the vacuum in the recipient below $10^{-9}$–$10^{-10}$ mm Hg. Air or gaseous nitrogen enter the space 100 and are for the most part sublimated on the ribs 99 in the space 100, but a certain portion forces its way in a viscous condition through the clearance 98 to the ribs 99 in the space 96 and is sublimated on ribs in the space 96 and on surfaces of the cryopanel 95, facing the space 96. The sublimate, thus formed at the temperature of liquid helium, provides an extremely efficient cryosorbent of gaseous helium, to say nothing of hydrogen.

3. The pump illustrated in FIG. 6 may be started without any auxiliary recipient evacuation means, exhausting it directly from 760 to $10^{-13}$ mm Hg, in case the recipient cubic content does not exceed several hundreds $dc^3$.

This is accomplished in the following way.

Liquid nitrogen is poured to fill almost one-third of the height of the trough 106, making sure that the temperature of the cryopanel 114 is substantially higher than the liquid nitrogen temperature.

Liquid helium is thereupon poured through the tube 103 into the vessel 88, its vapours being discharged from a lower than the cover 92 level through an additional tube sunk into the tube 104 until it is between the tray 89 and the cover 92. This is to ensure that the temperature of the cryopanel 95 is as high as possible, until the arrival of liquid helium under the tray 89. Liquid helium appears under the tray 89, bringing its temperature to almost 4.2° K, and the vacuum in the recipient reaches the level of $10^{-7}$–$10^{-9}$ and higher at the expense of condensation and sublimation of air from the recipient upon the ribs 99 and the upper surface of the tray 89 in the process of being cooled to the helium temperature. The temperature of the cryopanels 95 and 114 is still higher than 77° K and no gases sublimate and condensate yet thereon.

As soon as the vacuum is up to $10^{-7}$ mm Hg, liquid helium is poured into the trough 106 to the brim and, lifting the tube, inserted into the tube 104 to discharge helium vapours, to a level not lower than the cover 93, the vessel 88 is also topped up with liquid helium. The cryopanel 95 acquires the liquid helium temperature, as trough cutting the space 96 off from external heat inflows, and the surface layer of gas, sublimated upon the surfaces of the ribs 99 and the upper part of the tray 89, assumes an appreciably lower intrinsic vapour pressure, the vacuum growing up to $10^{-13}$ mm Hg and higher. Residual hydrogen and helium, their average partial pressure content in air being $2 \cdot 10^5$ times less than that of nitrogen and other components taken together, are almost completely adsorbed by the air sublimate, because 100–1,000 molecules of nitrogen sublimate, for example, sorb on the average one molecule of helium at a temperature of 4.2° K. In air the ratio is one helium molecule to 200,000 nitrogen molecules, a surplus large enough to ensure sorption of the residual helium. It is most important that the air sublimate be protected from any external heat inflows to maintain its temperature below 4.2° K, which is ensured by the presence of the blackened cryopanel 95 and the layer of sublimate-cryosorbent formed on the ribs 99 and in the space 96, much thicker than $10^5$–$10^6$ monolayers with an intrinsic vapour pressure of the order of $10^{-77}$ mm Hg.

To produce a vacuum of up to $10^{-13}$ mm Hg and higher in a recipient with profuse hydrogen liberation, the temperature of the tray 89 and the cryopanel 95 is to be brought down by liquid helium vapour evacuation from the vessel 88 through the tube 104.

This temperature can be lowered to 1.6° K with the help of a mechanical fore pump with an evacuation capacity of the order of 5 l/sec.

It is advisable, in case of profuse carbon dioxide liberation in the recipient, to bring down the temperature of the cryopanel 114 and the walls of the trough 106 below 77° K up to 50°–55° K, evacuating liquid nitrogen vapours from the trough 106 through tube 86, save liquid helium, if required.

What is claimed is:

1. A method of producing a vacuum in a recipient comprising: filling a vessel with a condensed phase gas mass, dividing the internal vessel volume into two spaces, wherein one space is connected to the recipient and another to a preliminary evacuation system, evacuating gases from the recipient through said gas mass, solidifying said gas mass when supercooled by the removal of surface vapours coincidental with said evacuation, thereby resulting in a pressure drop in the recipient from atmospheric to an initial vacuum pressure, and further cryosorption of the recipient residual atmosphere by a solid-phase gas, resulting in a high vacuum level in the recipient.

2. A method as claimed in claim 1, wherein the solidified mass is cooled by a refrigerant with a temperature lower than that of the mass to effect cryosorption of the recipient residual atmosphere.

3. A method as claimed in claim 2, wherein liquid nitrogen is employed as the condensed phase gas mass, and the refrigerant is selected from the group consisting of liquid hydrogen, solid hydrogen and liquid helium.

4. A method as claimed in claim 2, wherein solidified carbon dioxide is employed as the condensed phase gas mass, and the refrigerant is selected from the group consisting of liquid and solid nitrogen.

5. A cryopumping system for effecting a vacuum in a recipient, comprising a chamber with a bottom, a baffle disposed inside said chamber and dividing said chamber into two spaces, one of the spaces being connected to the recipient and the other space being connected to a recipient preliminary gas evacuation system, said baffle forming a clearance zone with at least one wall of said chamber for said spaces to communicate with each other; a condensed phase gas mass, disposed on the chamber bottom and blocking said clearance zone to provide cryocondensation and cryosorption surfaces ensuring production of a vacuum in the recipient.

6. The cryopumping system as claimed in claim 5, wherein ribs are attached to chamber walls in the clearance zone and, being higher than the clearance, provide for an optically tight blocking of said clearance; the chamber, ribs and baffle being made cooled for a more effective reduction of the temperature of all solidified gas mass acting as a cryosorbent.

7. The cryopumping system as claimed in claim 5, wherein said baffle is a cylindrical tube disposed vertically and forming an annular clearance zone with the bottom of said chamber blocked by the condensed phase gas mass.

8. The cryopumping system as claimed in claim 5, wherein ribs are formed by perforated rings, soldered to the bottom of said chamber and disposed coaxially about 5 mm apart.

9. The cryopumping system as claimed in claim 5, wherein the space of said chamber, communicating with the recipient, is optically tight covered by a cryopanel secured to said chamber and disposed over the gas mass, forming thus an enclosed volume completely isolated from heat inflows from the recipient.

* * * * *